US011933500B2

(12) United States Patent
Foeller et al.

(10) Patent No.: US 11,933,500 B2
(45) Date of Patent: Mar. 19, 2024

(54) HOB AND METHOD FOR ASSEMBLING SUCH A HOB

(71) Applicant: E.G.O. Elektro-Geraetebau GmbH, Oberderdingen (DE)

(72) Inventors: Thomas Foeller, Schwaigern (DE); Konstantin Freis, Bretten (DE); Michael Rupp, Eppingen (DE)

(73) Assignee: E.G.O. ELEKTRO-GERAETEBAU GMBH, Oberderdingen (DE)

( * ) Notice: Subject to any disclaimer, the term of this patent is extended or adjusted under 35 U.S.C. 154(b) by 112 days.

(21) Appl. No.: 17/454,635

(22) Filed: Nov. 12, 2021

(65) Prior Publication Data

US 2022/0163215 A1 May 26, 2022

(30) Foreign Application Priority Data

Nov. 25, 2020 (DE) ..... 10 2020 214 794.9

(51) Int. Cl.
*F24C 15/10* (2006.01)
*F24C 7/06* (2006.01)

(52) U.S. Cl.
CPC ..... *F24C 15/108* (2013.01); *F24C 7/06* (2013.01); *F24C 15/102* (2013.01)

(58) Field of Classification Search
CPC ..... F24C 15/102; F24C 7/06; F24C 15/108
(Continued)

(56) References Cited

U.S. PATENT DOCUMENTS 3,838,249 A * 9/1974 Detterbeck ..... F24C 15/10 219/465.1
5,859,410 A * 1/1999 White ..... F24C 15/102 219/452.11

(Continued)

FOREIGN PATENT DOCUMENTS

DE 10206062 A1 8/2003
DE 102007032757 A1 2/2008

(Continued)

OTHER PUBLICATIONS

European Patent Office, Extended European Search Report received for Application No. EP 21203345.0, dated Apr. 11, 2022, 9 pages, Germany.

(Continued)

*Primary Examiner* — Jimmy Chou
(74) *Attorney, Agent, or Firm* — Alston & Bird LLP

(57) ABSTRACT

A hob comprises a hob plate, heating devices therebelow and a flat, two-dimensional carrier plate for the heating devices which runs parallel to the hob plate and has an upper face, said carrier plate bearing the heating devices on said upper face and fixedly holding said heating devices in position. Holding means are provided on the upper face of the carrier plate for each heating device. Each heating device has at least one laterally protruding holding tab, wherein each holding tab has latching means and the holding means have counter latching means for a latching connection with these latching means. The latching connection has clearance in the direction perpendicular to the surface of the carrier plate. The holding means are fastened to the upper face of the carrier plate with a releasable fastening in the direction perpendicular to the surface of the carrier plate and with a positive connection in the direction parallel to the surface of
(Continued)

the carrier plate, wherein the holding tab runs above the carrier plate.

22 Claims, 6 Drawing Sheets

(58) Field of Classification Search
USPC ..... 219/452.11
See application file for complete search history.

(56) References Cited

U.S. PATENT DOCUMENTS

| | | | | |
|---|---|---|---|---|
| 5,954,981 | A * | 9/1999 | Deo | F24C 15/102 219/455.11 |
| 6,043,462 | A * | 3/2000 | Stedron | A47B 77/08 126/211 |
| 6,207,934 | B1 * | 3/2001 | Steiner | F24C 15/102 219/452.11 |
| 6,236,024 | B1 * | 5/2001 | Gotz | F24C 15/108 219/452.11 |
| 7,595,466 | B2 * | 9/2009 | Huber | H05B 3/74 219/460.1 |
| 9,883,553 | B2 * | 1/2018 | Aranda Vazquez | H05B 6/1245 |
| 10,251,220 | B2 * | 4/2019 | Isago | H05B 6/1209 |
| 2009/0127247 | A1 * | 5/2009 | Adam | F24C 15/108 219/452.11 |
| 2009/0294432 | A1 * | 12/2009 | Baek | H05B 3/748 219/448.11 |
| 2013/0008885 | A1 * | 1/2013 | Klein | F24C 15/108 219/452.11 |
| 2016/0234889 | A1 | 8/2016 | Aranda et al. | |
| 2016/0313009 | A1 * | 10/2016 | Pille | F24C 15/102 |

FOREIGN PATENT DOCUMENTS

| | | | | |
|---|---|---|---|---|
| DE | 102007032762 | A1 | 2/2008 | |
| ES | 2322978 | A1 | 7/2009 | |
| ES | 2533243 | A1 | 4/2015 | |
| WO | WO-2012062881 | A1 * | 5/2012 | F24C 15/102 |
| WO | WO 2015/049602 | A1 | 4/2015 | |

OTHER PUBLICATIONS

German Patent and Trade Mark Office, Office Action received for Application No. 10 2020 214 794.9, dated Sep. 14, 2021, 7 pages, Germany.

* cited by examiner

HOB AND METHOD FOR ASSEMBLING SUCH A HOB

CROSS-REFERENCE TO RELATED APPLICATIONS

This application claims priority to German Application No. 10 2020 214 794.9, filed Nov. 25, 2020, the contents of which are hereby incorporated herein in its entirety by reference.

FIELD OF APPLICATION AND PRIOR ART

The invention relates to a hob and a method for assembling such a hob or, respectively, for the assembly of such a hob. The hob comprises a hob plate and heating devices therebelow, wherein the heating devices are arranged and are fastened on a two-dimensional carrier plate, in particular are borne by the carrier plate.

A corresponding hob is disclosed in DE 10206062 A1. In this case, the heating devices in the form of induction heating coils are fastened to different holes which are arranged in specific hole patterns, for example by being screwed down. Alternatively, slots may be provided. A positioning of the heating devices which is variable but also accurately predeterminable may be implemented by means of the different holes or slots.

OBJECT AND SOLUTION

The object of the invention is to provide a hob as mentioned in the introduction and a method for assembling such a hob by which problems of the prior art may be remedied and, in particular, it is possible to fasten heating devices in an advantageous manner to the carrier plate.

This object is achieved by a hob having the features of claim 1 and by a method having the features of claim 23. Advantageous and preferred embodiments of the invention form the subject matter of the further claims and are described in more detail hereinafter. In this case, some of the features are described only relative to the hob or only relative to the method. Irrespective thereof, however, they are designed to be able to apply both to a hob and to a corresponding method independently and irrespective of one another. The wording of the claims is made by expressly referring to the contents of the description.

The hob comprises a hob plate and heating devices below the hob plate. Moreover, the hob comprises a two-dimensional carrier plate for the heating devices which is flat, which runs parallel to the hob plate and which has an upper face. The carrier plate bears the heating devices on the upper face, wherein these heating devices are held fixedly in position. Thus the heating devices are not able to be displaced when the hob is transported and their position always remains the same. Holding means are provided on the upper face of the carrier plate for each heating device, said holding means holding the heating device level and accurately against movement, so that advantageously they are able to move by a maximum of 1 cm.

According to the invention, each heating device has at least one laterally protruding holding tab, advantageously two holding tabs. Each holding tab has latching means, wherein the holding means have counter latching means in order to form or, respectively, create a latching connection with the latching means of the holding tab. Such a latching connection may be advantageously configured such that it forms at least one captive securing means, so that after the latching connection is produced the holding means are not lost or, for example, able to fall off from the holding tab or, respectively, from the heating device. Thus, for example, a heating device with latched-on holding means may be transported separately, so as to be subsequently connected to the carrier plate. In the latching connection, therefore, a clearance may be provided if required in the direction perpendicular to the carrier plate, and the latching connection does not necessarily have to have a single possible position.

The holding means are fastened, and namely releasably fastened, to the upper face of the carrier plate, wherein such a release of the fastening is possible in the direction perpendicular to the carrier plate. Advantageously, the fastening is improved by adhesive bonding but may be removed or, respectively, released by corresponding force. In a direction parallel to the surface of the carrier plate, the holding means are fastened by a positive connection to the carrier plate since this is actually the only possibility of movement for the holding means or, respectively, the heating device when the hob is fully assembled. The holding tab in this case runs above the carrier plate or, respectively, is located above the carrier plate, and it bears against the holding means or, respectively, is connected by a latching connection to the holding means. The connection is advantageously positive and may be formed at least partially by the latching connection or the elements provided therefor. Further elements may be provided for a positive and thus stable connection.

Thus it is possible that the holding means may be fastened to the carrier plate, preferably in a single position or, respectively, in a positionally accurate manner. By connecting the heating device via the holding tab to the holding means by means of a latching connection, an assembling of the hob or a pre-assembling of the heating device with the holding means may be carried out in a very rapid and simple manner.

In one embodiment of the invention, each heating device may have exactly two holding tabs which are preferably uniformly distributed. Particularly preferably, the holding tabs are located opposite one another on the heating device. A holding tab or, respectively, each holding tab protrudes outwardly from an outer edging of the heating device so that it may be easily reached during the assembling of the hob and namely both with and without the holding means latched thereon.

For the latching means on the holding tabs, it may be provided that they are configured as a latching opening. In this case the latching means have at least one latching edge, preferably a latching opening has two latching edges which are spaced apart. These latching edges are advantageously parallel to one another. A latching hook of the holding means may act on each latching edge. Preferably, each holding tab has just one latching opening.

Advantageously all of the holding tabs are configured identically, which may also apply to the holding means. As a result, it is possible to simplify the production and the provision of the parts for assembling the hob.

In an advantageous embodiment of the invention, the holding tab is configured to be flat. The holding tab may run parallel to the surface of the carrier plate. Thus the holding tab may be configured in a simple manner and does not require any additional or complex constructional height.

The holding tab may be provided on a carrier or, respectively, heating element carrier of the heating device. In this case, the holding tab may be either integrally formed on this heating element carrier, in particular when the heating element carrier is a plastics injection-molded part. Such a heating element carrier may be plate-shaped. Alternatively, the holding tab may be connected by a type of connecting portion or connecting part to such a heating element carrier, so that the holding tab is not fastened integrally thereto but may be positioned thereon or, respectively, fastened thereto. Thus, as described above, it may also be provided that all of the holding tabs together with the connecting parts are configured identically, i.e. they are only present in a single type, and thus are connected in the same manner to the heating element carriers. An aforementioned heating element carrier advantageously also consists of plastics, as is known per se.

For the embodiment of the holding means it may be provided that said holding means have at least one latching hook which protrudes upwardly or perpendicular to the surface of the carrier plate and which forms the counter latching means for the latching means or latching opening on the holding tab. Advantageously, each holding means has two latching hooks. Such a latching hook may have a latching bevel at the top on a free end and a downward latching action. This may be formed by a latching projection which faces toward the carrier plate and which is configured in the vicinity or on the free end of the latching hook. A height of the latching projection above the carrier plate and/or above the holding tab may be at least twice to three times the thickness of the holding tab. Thus, whilst the holding means may be fastened or latched to the holding tab by the latching connection, a movement clearance is also provided after the latching, which permits the holding means to be moved relative to the holding tab and thus relative to the heating device, for example for simplified assembling on the carrier plate. Due to the mobility within this latching connection, preferably a spring path may also be achieved with a spring height of the heating device above the carrier plate.

Advantageously, two latching hooks are provided on a holding means as counter latching means. These two latching hooks may be configured equally and protrude from the holding means at a distance from one another. The two latching hooks may be arranged so to speak with their backs to one another or, respectively, arranged on a base part such that the aforementioned latching projections face in opposing directions or, respectively, away from one another. The latching projections may be configured and arranged mirror-symmetrically, wherein such a plane of symmetry runs therebetween in the center.

In an advantageous embodiment of the invention, a centering projection which protrudes in a direction at right-angles from the surface of the carrier plate may be configured on the holding means. This centering projection may serve, when positioning the holding means on the holding tab, to locate the correct relative position, in particular for a simple and correct production of the latching connection. In this case, the centering projection may extend through an opening in the holding tab, in particular a fully edged opening. Particularly advantageously, this may be the same latching opening which forms the latching means with the at least one above-described latching edge, preferably with the two above-described latching edges. This latching opening is thus configured to be relatively large in comparison with the latching hooks which, however, bear with their latching projections against the latching edges.

It may be advantageously provided that the centering projection is arranged between two aforementioned latching hooks of a holding means. In particular, the centering projection runs through the aforementioned plane of symmetry or along the aforementioned plane of symmetry, so to speak. The centering projection is preferably at least as high as the latching hooks, preferably higher. Thus it may be achieved that initially the centering projection, as the first region of the holding means, engages through the latching opening or, respectively, creates the connection with the holding tab when the latching connection is produced. Thus the latching hooks are moved thereon in a uniformly accurate manner and as desired.

In an embodiment of the invention, the centering projection may have an elongated cross-sectional surface in a cutting plane parallel to the surface of the carrier plate. The centering projection is thus configured to be elongated, advantageously with a thinner region in the center and thicker regions at the two ends of the aforementioned elongated cross section. The distance thereof from the latching hooks may be a few millimeters so that when the latching connection is produced the latching hooks are potentially able to extend in the vicinity of the centering projection or even bear thereagainst.

The holding means may have a base part which may be configured as a base plate. Such a base plate may run parallel to the surface of the carrier plate. The base part in this case may bear against the upper face of the carrier plate, in particular with its lower face. Here the base part may be advantageously firmly bonded. An adhesive bonding of the holding means or, respectively, the lower face of the base part to the carrier plate may be carried out either by means of a pasty adhesive to be applied, or alternatively with a type of double-sided adhesive tape with a covering layer over the exposed adhesive layer, which is designed to be then adhesively bonded to the carrier plate. By removing this covering layer, an adhesive bonding may be carried out in a very simple manner.

At least one fastening projection may protrude downwardly from the base part and engage in a fastening opening in the carrier plate. Advantageously, two fastening projections are provided here on each base part, wherein each fastening projection engages in a separate fastening opening in the carrier plate. These fastening projections in the fastening openings form the positive connection of the fastening of the holding means to the carrier plate, since they prevent a lateral displacement or movement.

A fastening opening may correspond in terms of shape to the design of the fastening projection so that an accurate positioning is also implemented.

Advantageously, it is provided that a fastening projection does not protrude downwardly over the lower face of the carrier plate. Thus it is achieved that functional units, for example power electronics and/or control components, printed circuit boards or the like attached thereto at that point, are not touched or impaired by a fastening projection protruding over the lower face of the carrier plate. With a thickness of the carrier plate of between 1 mm and 5 mm, the engagement of the fastening projections in the fastening openings also achieves the desired positive connection.

In a preferred embodiment of the invention, a fastening projection may be elongated as a type of rail. The longitudinal direction may run in a direction parallel to the surface of the carrier plate. A width of the fastening projection may remain uniform so that a simple production is possible and potentially a holding means may be fastened to the carrier plate in any orientation. A longitudinal direction of an elongated fastening projection may run at right-angles to a line from a central point of the heating device to the holding tab. If two fastening projections are provided on the holding means, advantageously both fastening projections are configured to be elongated and particularly advantageously to be both identical. This naturally also applies to the respective fastening opening thereof.

In a further embodiment of the invention, it may be provided that a fastening projection which protrudes from the lower face of the base plate or, respectively, the base part, protrudes in at least one direction parallel to the surface of the carrier plate over the base part, i.e. is also visible from above. This serves as an assembling aid so that the fastening projections of the holding means may be pushed more easily into the fastening openings in the carrier plate. An elongated fastening projection advantageously protrudes at both ends over the base part, for example with an overlap of 1 mm to 5 mm. This is sufficient for good visibility and optionally here a fitter may also grip and guide the holding means more easily by hand.

If two fastening projections are configured on the base part, they may be at a distance from one another. Advantageously, elongated fastening projections run parallel to one another. Such a distance may be between 10 mm and 40 mm. The adhesive bonding of the lower face of the base part to the carrier plate may take place at this distance, advantageously with a previously described adhesive layer. The lower face of the base part in this region should be as planar as possible or, respectively, have no projections. In some circumstances, cutaway sections or cutouts may be provided therein, which facilitate a production by means of injection-molding.

A clearance between the fastening openings and the fastening projections may be between 0.1 mm and 2 mm, particularly advantageously a maximum of 1 mm or a maximum of 0.4 mm. Thus it is possible to predetermine the position of the holding means on the carrier plate and thus also the entire heating device in a very accurate manner.

In an embodiment of the invention, it may be provided that cutaway sections or, respectively, recesses are formed on the lower face of the base part at a transition between the fastening projections and this lower face. These cutaway sections or, respectively, recesses may be recessed in a direction perpendicular to the surface of the carrier plate. They are used, during a stamping process of the fastening openings, such that metal edges or burrs on the fastening openings protruding into a carrier plate made of metal are able to extend therein and thus do not bear against the lower face of the base part. This could result in an accurate fit. Thus the fastening openings may be stamped out in a simpler manner and with less effort or, respectively, accuracy. The aforementioned adhesive agent in the form of an adhesive layer, for example as a double-sided adhesive tape with a thickness of 0.1 mm and 2 mm, may be optionally recessed here so that the aforementioned edges or burrs are not pushed therein.

In a further embodiment of the invention, a projection may protrude from each holding tab in the direction away from the heating device, in particular from the aforementioned base part of a holding tab. Such a projection may be a maximum length of 10 mm or, respectively, protrude from the holding tab. By such a projection it is additionally possible to guide the holding tab when positioning the heating device on a carrier plate with the holding means fastened thereon. If the holding means are already firmly latched to the holding tabs and this entire structural unit is then fastened to a carrier plate, this is advantageously carried out by a fitter gripping the holding means and attaching said holding means to the carrier plate.

A carrier plate may advantageously generally consist of metal, in particular of aluminum. For the sake of simplicity the aforementioned fastening openings are stamped out from said carrier plate, wherein advantageously for a carrier plate only those fastening openings are stamped out at the corresponding points which are required for fastening heating devices with holding tabs and holding means thereto. Thus advantageously no further sets or arrangements of fastening openings are stamped out, a few or the majority thereof no longer being required afterwards. A stamping procedure is advantageously carried out in a stamping direction from the lower face of the carrier plate to the upper face. This keeps the lower face free of the aforementioned edges or burrs of the stamping procedure and on the upper face these edges or burrs may be concealed by the holding means fastened thereto in order to protect against the risk of injury, wherein the burrs may be received so to speak by the aforementioned cutaway sections or recesses.

The carrier plate, the heating devices and the holding means are provided for assembling a hob according to the invention, these components initially still being respectively separated. In this case, advantageously adhesive agent is already provided on the holding means but not yet activated, in the sense that for example double-sided adhesive tape is still provided with a covering layer. In a first embodiment of the method according to the invention, initially the holding means are attached to a holding tab of a heating device by latching. Then the adhesive agent is applied or activated, in particular by removing an aforementioned covering layer. Then the structural units of the heating device and holding means are fastened to the carrier plate by pushing the fastening projections into the fastening openings and being adhesively bonded.

In a second embodiment of the invention, initially the adhesive agent is applied or activated on the holding means and said holding means are then adhesively bonded to the carrier plate. This is advantageously carried out for all holding means which are provided for a single heating device, i.e. particularly advantageously two holding means. Then by latching the holding tabs to the holding means the heating device is fastened thereto, so that the heating device is fastened to the carrier plate. This may be provided for each heating device for the hob in succession.

These and further features are additionally revealed from the claims and from the description and the drawings, wherein in each case the individual features may be implemented individually per se or in a plurality thereof in the form of sub-combinations in an embodiment of the invention and relative to other fields, and advantageous and protectable embodiments per se, for which protection is claimed here, may be shown. The subdivision of the application into sub-headings and individual sections does not limit the statements made thereunder in terms of the generality thereof.

BRIEF DESCRIPTION OF THE DRAWINGS

Exemplary embodiments of the invention are shown schematically in the drawings and are described in more detail hereinafter. In the drawings.

DETAILED DESCRIPTION OF THE EXEMPLARY EMBODIMENTS

Figure 1:
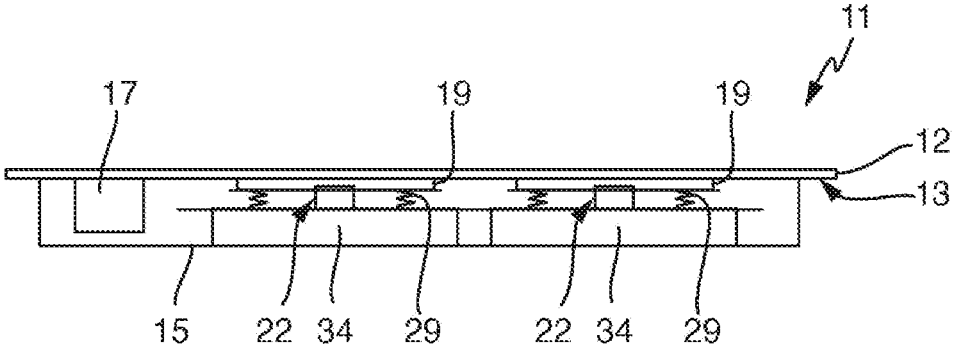
FIG. 1 shows a section through a hob according to the invention with a hob plate, induction heating coils being pushed onto the lower face thereof and being assembled on a carrier plate.

In FIG. 1 a hob 11 according to the invention is shown in a simplified sectional view. The hob has a hob plate 12 which may consist, for example, of glass ceramic. Fastened to a lower face 13 of the hob plate 12 is a hob housing 15 which may consist, for example, of plastics, and an operating device 17 with operating elements, for example touch-sensitive switches, and a hob controller. Moreover, the hob housing 15 has power electronics 34 which may be contained in one or two modules. A sheet metal carrier plate 30 which corresponds to the carrier plate according to the invention and which is parallel to the hob plate is provided above the power electronics 34, possibly directly placed thereon. The sheet metal carrier plate consists of aluminum with a thickness of 2 mm, wherein the thickness and material may also be modified. Induction heating coils 19 as heating devices, which are pushed upwardly in a resilient manner by means of springs 29, are arranged at the top on the sheet metal carrier plate 30. By means of the springs 29 the induction heating coils 19 are pushed with a certain force onto the lower face 13 of the hob plate 12 for a defined position, both relative to a distance from the upper face of the hob plate 12, onto which a pot to be heated is placed, and in a direction parallel to the hob plate 12 and sheet metal carrier plate 30. The holding tabs 22 according to the invention are shown in simplified form here, and relative to the holding means reference is primarily made to FIGS. 9, 10 and 12.

Figure 2:
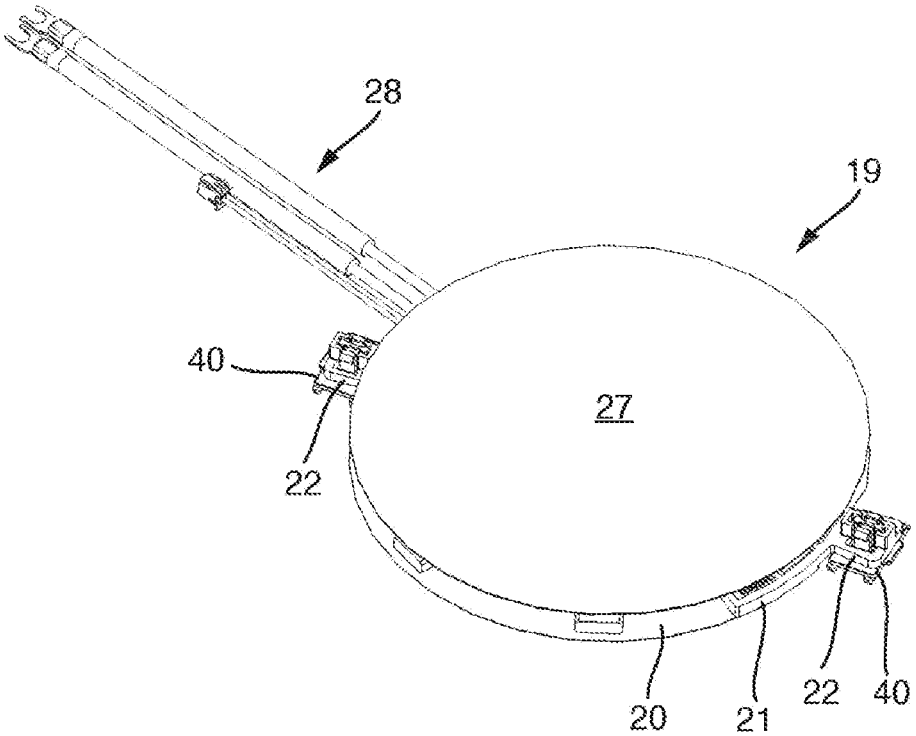
FIG. 2 shows an oblique view from above of an induction heating coil of the hob of FIG. 1 with two lateral holding tabs, holding means being latched thereto.

In FIG. 2 an induction heating coil 19 is shown from above in an oblique view, which partially corresponds to the prior art. The induction heating coil 19 has a round lower part 20 which is advantageously made of plastics and on which magnetic cores, indicated amongst other things, and thereabove the coil windings, not shown, are arranged. Toward the top the induction heating coil 19 is covered by an upper part 27 which may also consist of plastics, alternatively from heat-resistant mica. Connecting cables 28 are guided from the rear at the left.

A reinforcing region 21 on the lower part 20, which may be configured in one piece or, respectively, integrally formed thereon, may be clearly identified in FIG. 2 to the right, alternatively it may be configured as a separate part and then fastened to the lower part 20, for example adhesively bonded thereto, latched thereto or screwed thereto. The reinforcing region 21 has a considerably greater thickness than the lower part 20 itself and transitions into a holding tab 22 according to the invention which protrudes outwardly and namely parallel to the principal surface of the lower part 20 and thus also parallel to the sheet metal carrier plate 30. From FIG. 9 it may be identified that the lower face of the holding tab 22 runs slightly above the lower face of the other induction heating coil 19 and thus also of the lower part 20. This is described hereinafter in further detail. Also shown in FIG. 2 is a holding means 40 according to the invention which is latched onto the holding tab 22. This is described in more detail hereinafter.

Figure 3:
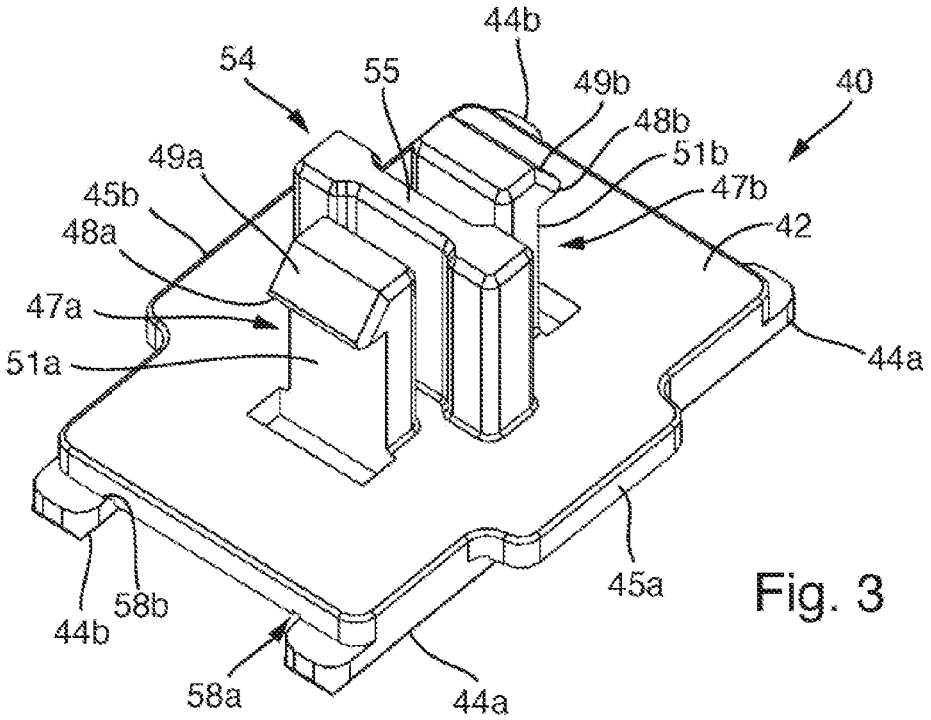
FIG. 3 shows a holding means corresponding to FIG. 2 in an enlarged oblique view obliquely from above.

FIG. 3 shows the holding means 40 alone in a view obliquely from above, similar to the position which is shown in FIG. 2. The holding means 40 consists of plastics and has an inherently rectangular base plate 42, for example with a thickness of 2 mm to 4 mm. Two fastening rails 44*a* and 44*b*, which correspond to the fastening projections according to the invention, protrude from a lower face of the base plate 42, as primarily the oblique view from below according to FIG. 5 shows. As may be identified from FIG. 9, they protrude downwardly approximately with the thickness of the base plate 42 or, respectively, are equally thick. The fastening rails run parallel to one another and face downwardly to form peripheral bevels for simpler insertion in corresponding openings in the sheet metal carrier plate 30. Moreover, according to the plan view according to FIG. 4 the fastening rails protrude by a few millimeters in their longitudinal direction over the base plate 42, and namely at both ends. According to FIG. 5 it may also be seen that elongated recesses 58*a* and 58*b* run at the transition from a lower face 57 of the base plate 42 to the fastening rails 44*a* and 44*b*. The elongated recesses may extend, for example, 0.5 mm to 1 mm deep into the lower face 57 and serve to receive or, respectively, to compensate for stamped edges or burrs of the openings in the sheet metal carrier plate 30.

Two identically configured projections 45*a* and 45*b* protrude from the base plate 42 on opposing sides. These projections serve for simplified handling of the holding means 40, for example even when they are already latched, according to FIG. 2, onto the induction heating coils 19 or, respectively, the holding tabs 22 thereof.

In a central region two latching hooks 47*a* and 47*b* protrude from the upper face of the base plate 42 upwardly or, respectively, are integrally formed thereon. The two latching hooks 47*a* and 47*b* have latching hook stems 51*a* and 51*b* protruding upwardly perpendicular from the base plate 42 on which the latching hooks are configured at the top with latching hook edges 48*a* and 48*b* and latching bevels 49*a*, and 49*b* at the upper end. The latching hooks face toward one another with their rear faces or, respectively, the latching hook edges 48*a* and 48*b* face away from one another. The latching hooks are located at the same height above the upper face of the base plate 42.

Figure 4:
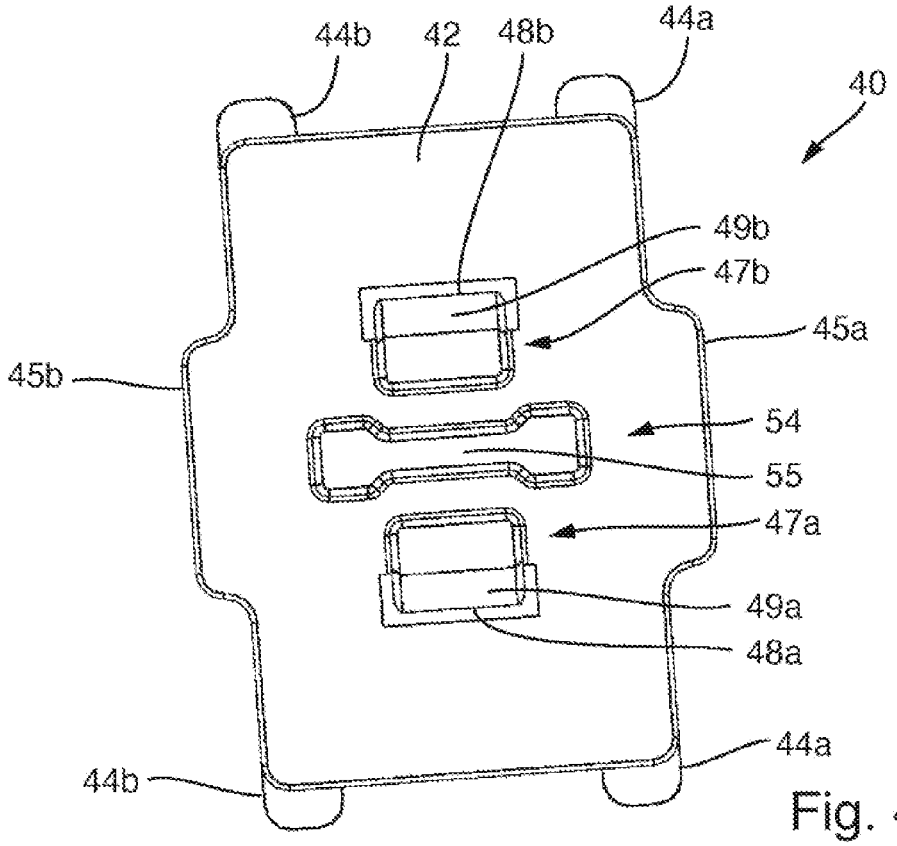
FIG. 4 shows a plan view of the holding means of FIG. 3.
Figure 5:
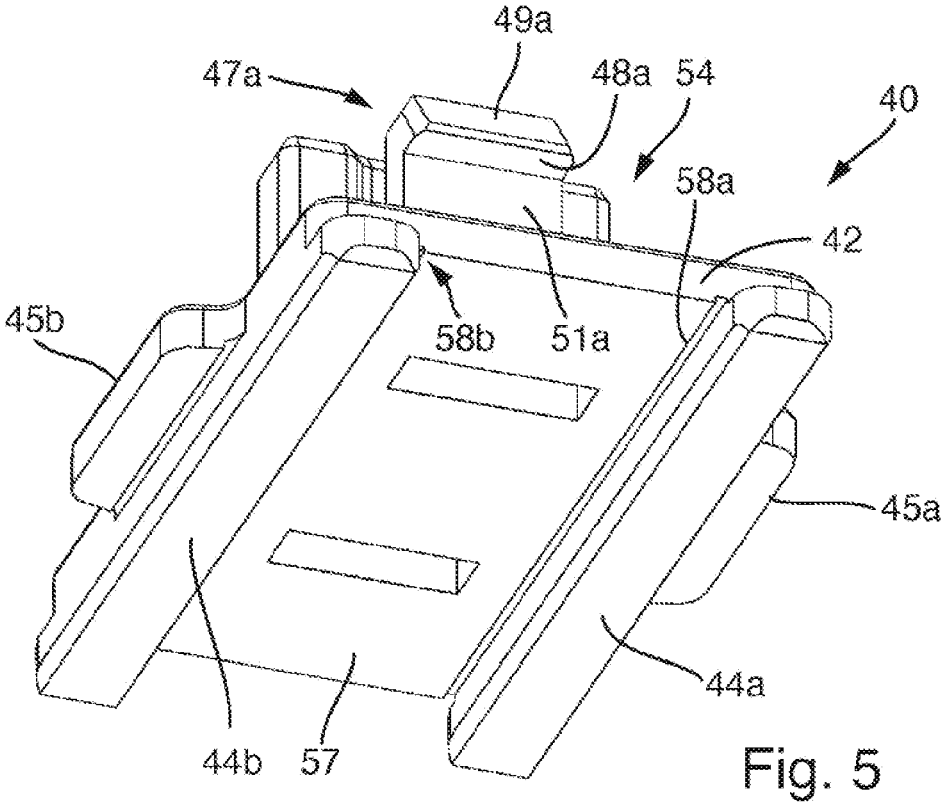
FIG. 5 shows an oblique view from below of the holding means of FIG. 3.

Exactly centrally between the latching hooks 47*a* and 47*b*, a centering projection 54 protrudes upwardly perpendicular from the base plate 42, said centering projection having an elongated cross section, see also the plan view of FIG. 4. This cross section is configured to be approximately bone-shaped, so that the centering projection 54 in the central region has a type of constriction 55 where it is narrower. This may serve the purpose that, when the latching connection is produced, the latching hooks 47*a* and 47*b* are pushed toward one another corresponding to the latching bevels 49*a* and 49*b*. Due to the constriction 55 slightly more space is present into which the latching hooks may deflect so to speak or, respectively, may be pushed further toward one another.

Advantageously, the two holding means 40 corresponding to FIG. 2, which are required in order to fasten the induction heating coil 19 to the sheet metal carrier plate 30, are identically configured. Moreover, the holding means are also mirror-symmetrical in two planes of symmetry which are perpendicular to one another and which in turn are perpendicular to the surface of the sheet metal carrier plate 30, and thus may be rotated or, respectively, latched onto the holding tabs 22 in any rotational direction. The fastening rails 44*a* and 44*b*, which in each case are of equal length, fit in all cases into the slots 31*a* and 31*b* in the sheet metal carrier plate 30, see also FIGS. 11 and 12.

Figure 6:
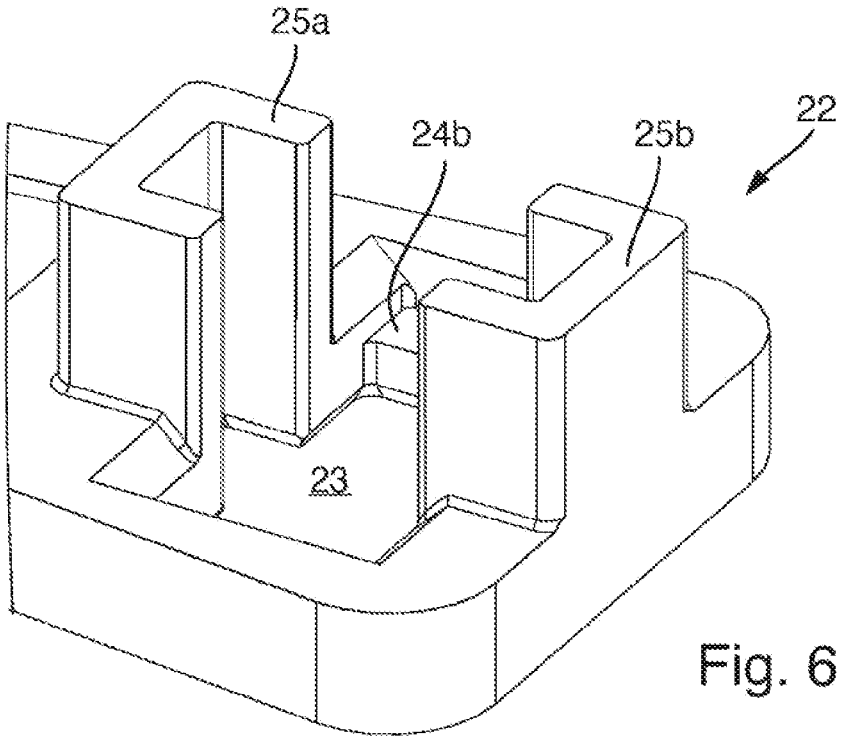
FIG. 6 shows an enlarged view obliquely from above of a holding tab of FIG. 2.

FIG. 6 shows an oblique view of the holding tab 22. The holding tab has a thickness which is significantly greater than that of the base plate 42 of the holding means 40, in particular is at least double the size. This is because in spite of a large latching opening 23 the holding tab has to have sufficient stability therein. The latching opening 23 runs so to speak around the latching hooks 47*a* and 47*b* and the centering projection 54. The latching opening has opposing latching edges 24*a* and 24*b* which the latching hook edges 48*a* and 48*b* of the latching hooks 47*a* and 47*b* are latched onto or, respectively, encompass. This corresponds to a conventional latching connection.

In the direction transversely thereto two centering guide slots 25*a* and 25*b* protrude upwardly over the holding tab 22, so to speak, between which the centering projection 54 is guided with its thicker ends. This may be clearly identified in FIGS. 7 and 8. In this case a distance may be provided between the centering guide slots 25*a* and 25*b* and the centering projection 54, which may be 0.5 mm to 3 mm. Thus a certain clearance is provided between the holding tab 22 and holding means 40 when they are latched together according to FIGS. 7 and 8 or, respectively, are latched to one another. This may be clearly identified in FIGS. 7 and 8. From FIG. 8 it may also be identified that here the centering projection 54 is as high as the latching hooks 47*a* and 47*b*. The centering projection could, however, also be higher, for example in order to engage initially in the latching opening 23 and thus, when the latching connection is produced, centering the two parts with one another before the latching connection starts or, respectively, before the latching bevels 49*a* and 49*b* act or, respectively, bear at the bottom against the holding tab 22, where advantageously conventional bevels are provided.

Figure 13:
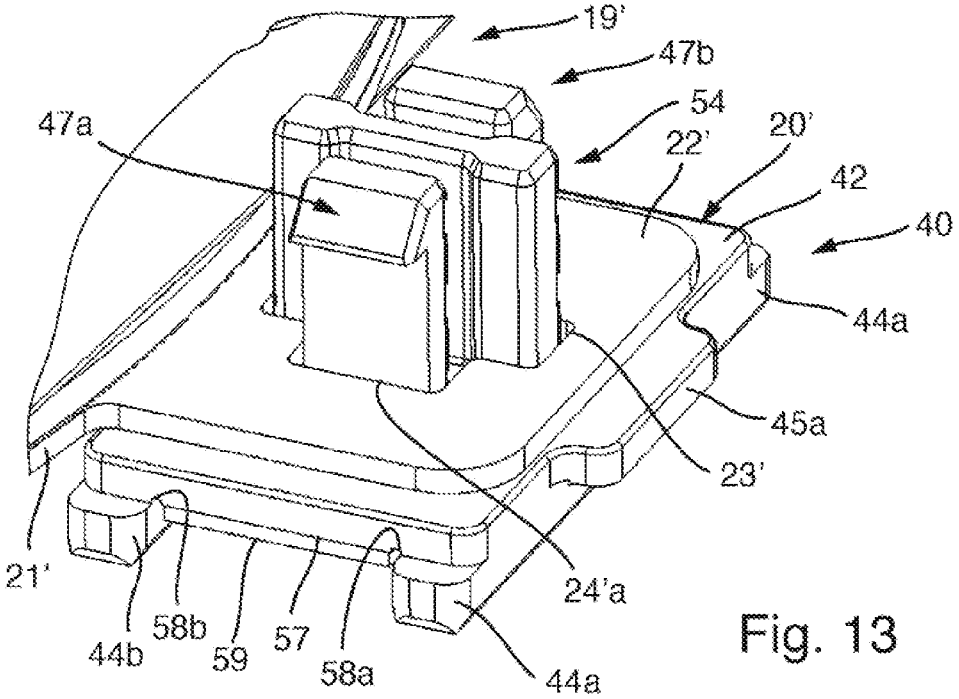
FIG. 13 shows a modification of a significantly flatter holding tab in a view similar to FIG. 7 with holding means latched thereon.

An alternative embodiment of a holding tab is shown in FIG. 13 with the holding tab 22' therein. This holding tab 22' is significantly thinner, in particular even slightly thinner than the base plate 42 of the holding means 40. The holding tab protrudes from a reinforcing region 21' which has the same relatively small thickness. The holding tab does not have a centering guide slot or the like but merely a latching opening 23' configured in the surface of the holding tab 22'. Also here the latching edges are formed from the edges of the latching opening 23' and the upper face of the holding tab 22', wherein only the latching edge 24'*a* for the latching hook 47*a* may be seen here. A distance may also be identified here between the latching hooks 47*a* and 47*b* and the centering projection 54 and the edge of the latching opening 23' which may be approximately as large as described above.

Figure 9:
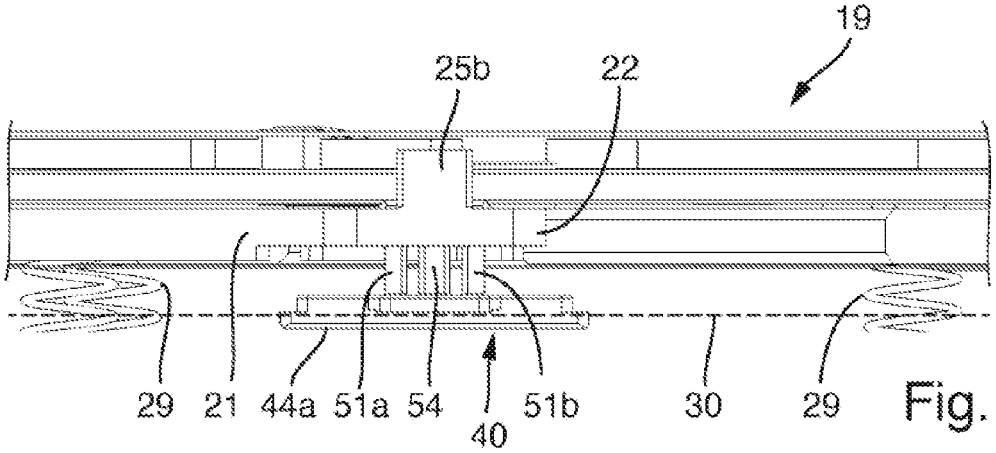
FIG. 9 shows a side view of the arrangement of an induction heating coil corresponding to FIG. 2 with the holding tab and holding means latched thereon on a sheet metal carrier plate with a slight distance and springs therebetween.

In FIG. 9, in a view similar to the sectional view of FIG. 1, it may be seen how the holding means 40 is latched from below on the induction heating coil 19 or, respectively, the holding tab 22 thereof and sufficiently far that the latching connection is produced immediately. This is why the holding means 40 protrudes sufficiently far downwardly over the holding tab 22. Springs 29, which are configured as coil springs, protrude downwardly from the lower face of the induction heating coil 19, for example to an extent of 0.5 cm to 1 cm or even up to 2 cm. Shown in dashed lines, the sheet metal carrier plate 30 is in a position if the fastening rails 44 of the holding means 40 were to be pushed into corresponding slots and the holding means 40 were to be firmly bonded. Thus it may be identified that the springs 29 would have to be already slightly pushed in, in this relative position between the holding tab 22 and holding means 40. Thus a certain amount of force is already required during assembling which, however, is simple to apply for a fitter.

Figure 10:
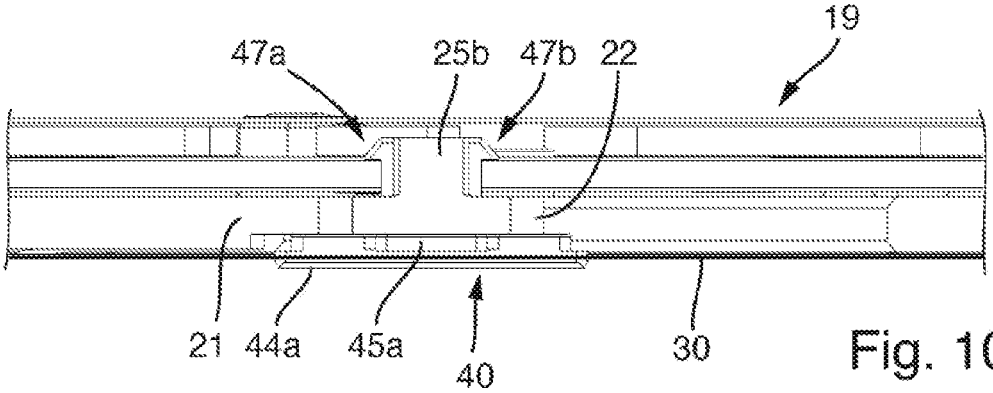
FIG. 10 shows the arrangement of FIG. 9 in the compressed state so that the holding tab bears against the holding means.

In the comparable view of FIG. 10, the induction heating coil 19 is pushed to maximum extent relative to the sheet metal carrier plate 30, the springs 29 are thus compressed to a maximum extent. Advantageously, the springs are arranged in spring receivers which are configured to be slightly recessed into the lower face of the induction heating coil 19 or, respectively, into the lower part 20, so that when the spring action is maintained they no longer protrude downwardly over the lower face of the lower part 20.

From the comparison of FIGS. 9 and 10 it may also be seen that the holding means 40 now bears or, respectively, stops completely against the lower face of the holding tab 22, and the latching hooks 47*a* and 47*b* extend to the upper face of the centering guide slots 25*a* and 25*b*. FIG. 10 is able to show the installed state in the maximum compressed position. Advantageously, however, in the installed state a distance of 0.5 mm to 5 mm is provided between the lower face of the holding tab 22 and the upper face of the base plate 42 of the holding means 40 in the finished hob 11, so that the springs 29 are able to act. This is, however, variable.

In FIG. 11 it is again shown in detail how the holding means 40 with the two fastening rails 44*a* and 44*b* is inserted in corresponding slots 31*a* and 31*b* in the sheet metal carrier plate 30 as fastening openings. An adhesive bonding is produced by an adhesive layer 59 applied to the lower face 57 of the base plate 42, for example formed by double-sided adhesive tape with a certain thickness of 0.5 mm to 3 mm. Here it may also be identified that a peripheral clearance between the fastening rails 44 and the slots 31 is approximately 0.5 mm, so that the positioning may be correspondingly inaccurate. Whilst this is sufficient, at the same time a certain production tolerance is compensated and the fastening or, respectively, insertion and adhesive bonding of the holding means 40 to the sheet metal carrier plate 30 is simplified thereby.

Figure 7:
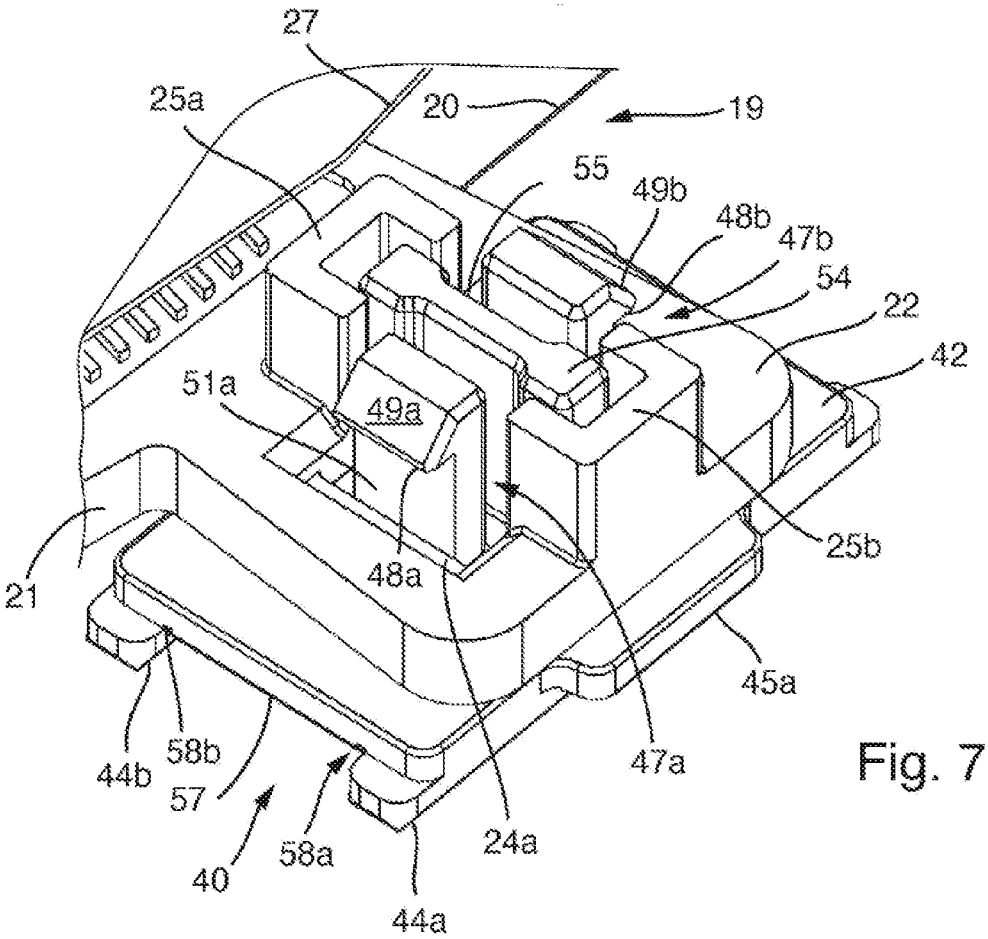
FIG. 7 shows an enlargement of the right-hand holding tab of the induction heating coil of FIG. 2 with holding means latched thereon.
Figure 8:
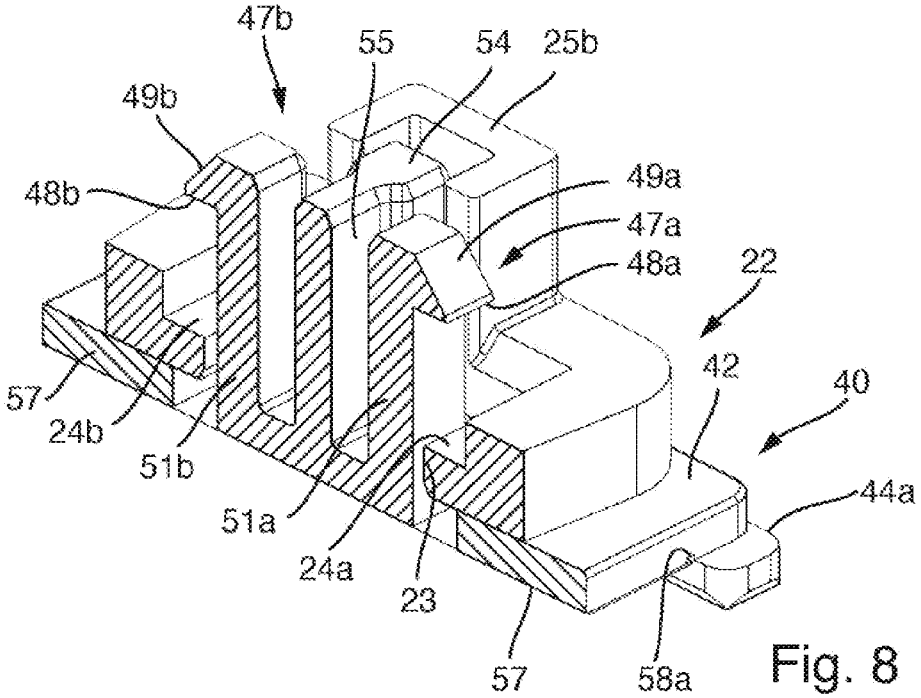
FIG. 8 shows a sectional view through the latching connection of the holding tab and holding means corresponding to FIG. 7.
Figure 11:
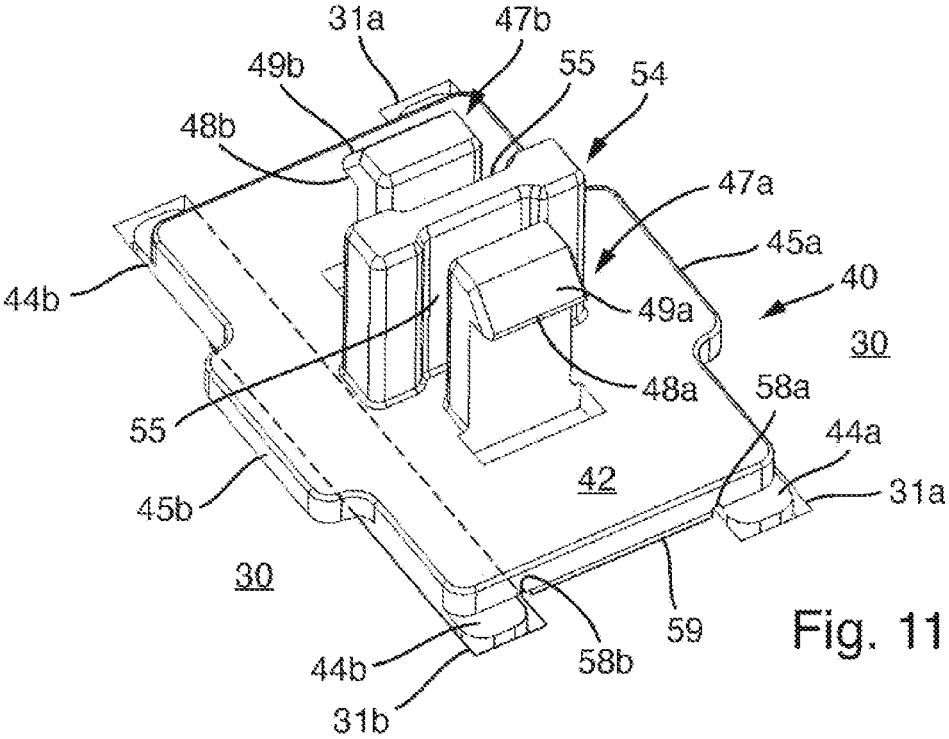
FIG. 11 shows an oblique view of the sheet metal carrier plate with two elongated slots into which the holding means with elongated fastening rails is inserted.
Figure 12:
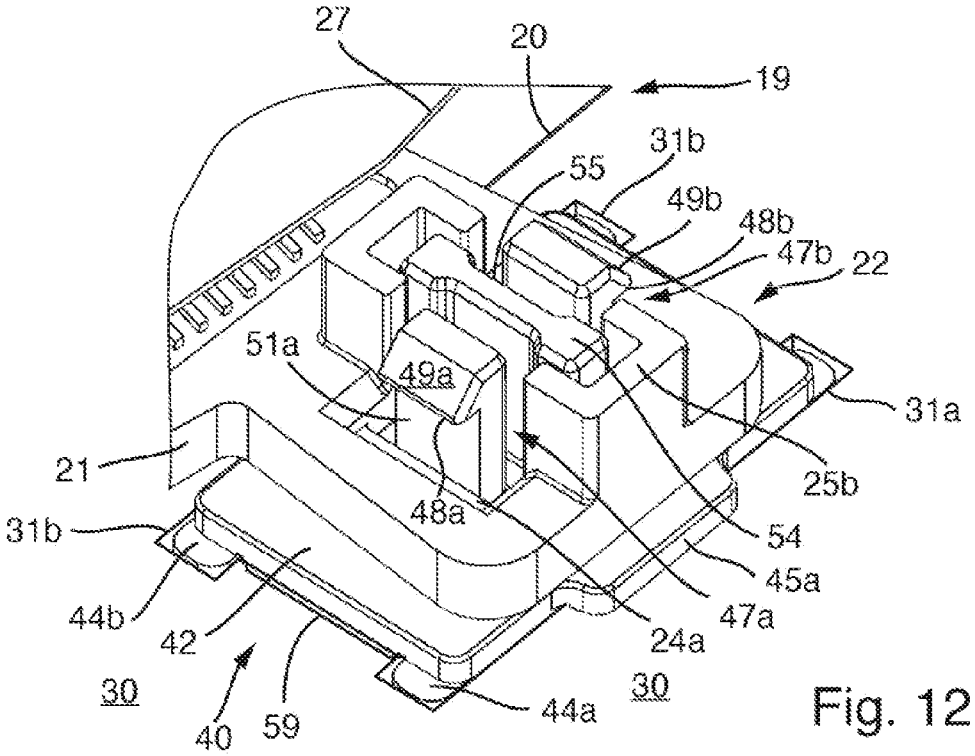
FIG. 12 shows the arrangement corresponding to FIG. 7 in which the holding means is fastened to the sheet metal carrier plate in a similar manner to FIG. 11.

FIG. 12, which is based on FIG. 7, in turn shows how the induction heating coil 19 is latched by means of the holding tab 22 to the holding means 40, wherein the holding means 40 corresponding to FIG. 11 is inserted and adhesively bonded to the sheet metal carrier plate 30. The adhesive bonding takes place by means of the adhesive layer 59, whereby the holding means 40 is prevented from being lifted off the sheet metal carrier plate 30. This adhesive layer 59 also substantially prevents a lateral displacement of the holding means 40 within the surface area parallel to the sheet metal carrier plate 30, so that generally the positive connection between the fastening rails 44 and the slots 31 is not necessarily required. This positive connection serves for the guidance and accuracy of the positioning of the holding means 40 during the fastening to the sheet metal carrier plate 30, and in the case of the occurrence of larger forces which exceed the adhesive action of the adhesive layers 59 or, respectively, could tear off these adhesive layers so to speak.

In an overall view of the figures it may be easily imagined how the assembling process may be carried out according to one of the two alternatives. In the first alternative, initially in each case a holding means 40 is latched, advantageously manually, onto the one holding tab 22 and then onto the other holding tab 22 of the induction heating coil 19. In this case the adhesive layer 59 on the holding means 40 is still covered or, respectively, deactivated, so to speak, in particular provided with a conventional tear-off film. Then the induction heating coil 19 is applied to the sheet metal carrier plate 30, wherein this may also involve transportation over a longer period of time and a greater distance. Shortly before fastening to the sheet metal carrier plate 30 the adhesive layer 59 is activated, in particular by tearing off the covering film, and then the induction heating coil 19 is positioned onto the sheet metal carrier plate 30 approximately in the desired position. Due to the arrangement of the adhesive layer 59 between the protruding fastening rails 44, the adhesive layer is not yet able to come into contact with the sheet metal carrier plate 30. Only when a holding means 40 with its fastening rails 44 engages, or is moved, into the corresponding slots 31 in the sheet metal carrier plate 30 does the adhesive layer 59 bear against the upper face of the sheet metal carrier plate 30 and bring about the adhesive bonding. The other holding means 40 on the other holding tab 22 of the induction heating coil 19 may also be already approximately in its dedicated position so that it is accurately pushed in the same manner with the fastening rails 44 into the slots 31 provided therefor and thus is adhesively bonded.

In the second alternative, it is provided that the two holding means 40 are initially fastened and adhesively bonded to a sheet metal carrier plate 30 by activating the adhesive layer 59. Either the induction heating coil 19 with the holding tabs 22 may be fastened or, respectively, latched thereto immediately afterwards, or alternatively in turn a transportation may be carried out over a longer period of time and a greater distance. Then an induction heating coil 19 with the holding tabs 22 is moved onto the holding means 40, and then either the latching is produced at the same time, or firstly the latching is carried out on the one holding tab 22 and then on the other holding tab 22.

Thus in the case of both alternatives the assembling may be carried out in a manner which is simple and not prone to error. In the assembled state the hob 11 is fit for purpose and robust.

The invention claimed is:

1. A hob comprising:

a hob plate, heating devices below said hob plate, a carrier plate for said heating devices, wherein said carrier plate is flat, disposed parallel to said hob plate, has an upper face that bears the heating devices and fixedly holds said heating devices in position, and holding means on said upper face of said carrier plate for each said heating device, wherein:

each said heating device has at least one laterally protruding holding tab, each said holding tab has latching means, said holding means have counter latching means for a latching connection with said latching means of said holding tab, said holding means are fastened to said upper face of said carrier plate with a releasable fastening in a direction perpendicular to a surface of said upper face of said carrier plate and with a positive connection in a direction parallel to said surface of said carrier plate, and said holding tab is disposed above said carrier plate.

2. The hob as claimed in claim 1, wherein each said heating device has two holding tabs, wherein said holding tabs are arranged on said heating device so as to oppose one another.

3. The hob as claimed in claim 2, wherein each said holding tabs protrude outwardly from an outer edging of said heating device.

4. The hob as claimed in claim 1, wherein said latching means are configured on said holding tabs as a latching opening with at least two latching edges, said latching edges being spaced apart and being parallel to each other.

5. The hob as claimed in claim 1, wherein said holding tab is configured to be flat and runs parallel to said surface of said carrier plate.

6. The hob as claimed in claim 1, wherein said holding means have at least one latching hook, said latching hook protruding upwardly or perpendicular to said surface of said carrier plate as counter latching means.

7. The hob as claimed in claim 6, wherein a latching bevel is configured at a top on a free end of said latching hook, wherein said latching action faces downwardly.

8. The hob as claimed in claim 7, wherein said latching hook has a latching projection facing said carrier plate, said latching hook edges being arranged on a free end of said latching hook, said latching hook being at a height above said carrier plate or above said holding tab, said height being at least twice a thickness of said holding tab.

9. The hob as claimed in claim 7, wherein two said latching hooks are provided as counter latching means, said two latching hooks being protruding from said holding means at a distance from one another.

10. The hob as claimed in claim 1, wherein a centering projection which protrudes in a direction at a right-angle from said surface of said carrier plate is configured on said holding means, wherein said centering projection extends through an opening in said holding tab.

11. The hob as claimed in claim 6, wherein a centering projection which protrudes in a direction at a right-angle from said surface of said carrier plate is configured on said holding means, wherein said centering projection extends through an opening in said holding tab, wherein said centering projection is arranged between two latching hooks on said holding means.

12. The hob as claimed in claim 1, wherein said holding means have a base plate parallel to said surface of said carrier plate, said base plate bearing against the upper face of said carrier plate, wherein said base plate is firmly bonded to said upper face of said carrier plate.

13. The hob as claimed in claim 12, wherein at least one fastening projection protrudes downwardly from said base plate and engages in a fastening opening being provided in said carrier plate.

14. The hob as claimed in claim 13, wherein said fastening projection does not protrude downwardly over a lower face of said carrier plate, wherein each said fastening projection does not protrude downwardly over said lower face of said carrier plate.

15. The hob as claimed in claim 13, wherein said fastening projection is elongated in a direction parallel to said surface of said carrier plate, wherein a longitudinal direction runs at a right-angle to a line from a central point of said heating device to said holding tab.

16. The hob as claimed in claim 13, wherein said fastening projection protrudes at one end over said base plate in a direction parallel to said surface of said carrier plate.

17. The hob as claimed in claim 13, wherein two said fastening projections have an elongated shape which is are provided on said base plate, said fastening projections being at a distance from one another, an adhesive bonding to said carrier plate being provided in said distance.

18. The hob as claimed in claim 13, wherein fastening openings for said fastening projections are configured with a precise clearance with a clearance of a maximum of 1 mm.

19. The hob as claimed in claim 13, wherein cutaway sections or recesses are configured in said base plate at a transition between said fastening projection and a lower face of said base plate in a direction perpendicular to said surface of said carrier plate.

20. The hob as claimed in claim 1, wherein a projection protrudes from said holding tab or from said base plate in a direction away from said heating device in a direction parallel to said surface of said carrier plate or with a maximum length of 10 mm.

21. The hob as claimed in claim 13, wherein said carrier plate consists of metal, and fastening openings are stamped out from said carrier plate in a stamping direction from a lower face of said carrier plate to said upper face on which said heating devices are fastened.

22. The hob as claimed in claim 1, wherein said heating devices have at least one heating element and one heating element carrier, wherein said heating element carrier has said at least one holding tab on an outer edge, wherein said holding tabs are connected in one piece and integrally to said heating element carrier.

* * * * *